US006674411B2

(12) United States Patent
Boyle

(10) Patent No.: US 6,674,411 B2
(45) Date of Patent: Jan. 6, 2004

(54) ANTENNA ARRANGEMENT

(75) Inventor: Kevin R. Boyle, Horsham (GB)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 10/085,696

(22) Filed: Feb. 27, 2002

(65) Prior Publication Data

US 2002/0149524 A1 Oct. 17, 2002

(30) Foreign Application Priority Data

Mar. 3, 2001 (GB) ..... 0105441

(51) Int. Cl.[7] ..... H01Q 1/50
(52) U.S. Cl. ..... 343/860; 343/702; 343/700 MS
(58) Field of Search ..... 343/700 MS, 702, 343/850, 860, 846

(56) References Cited

U.S. PATENT DOCUMENTS 5,319,378 A * 6/1994 Nalbandian et al. . 343/700 MS
5,886,669 A * 3/1999 Kita ..... 343/718
5,969,681 A 10/1999 O'Neill, Jr. ..... 343/700 MS
6,181,280 B1 * 1/2001 Kadambi et al. .... 343/700 MS
6,297,776 B1 * 10/2001 Pankinaho ..... 343/700 MS
6,466,170 B2 * 10/2002 Zhou ..... 343/700 MS

FOREIGN PATENT DOCUMENTS

EP 0997974 5/2000 ..... H01Q/9/04

* cited by examiner

*Primary Examiner*—Tho Phan
*Assistant Examiner*—Shih-Chao Chen

(57) ABSTRACT

An antenna arrangement comprises a patch conductor (102) supported substantially parallel to a ground plane (104) and a feed conductor (106) connected to the patch conductor. Such an arrangement is similar to a conventional Planar Inverted-F Antenna (PIFA), but lacks the additional grounding conductor connected between the patch conductor and the ground plane in known PIFAs. Elimination off this grounding conductor enables matching to be performed by external circuitry, thereby enabling a better match to be achieved and enabling similar performance to conventional PIFA antennas to be achieved from a reduced volume. These advantages are particularly apparent for dual-band (or multi-band) operation, where the use of a dual-band matching circuit allows a much smaller end less complex antenna to be used.

8 Claims, 7 Drawing Sheets

ANTENNA ARRANGEMENT

BACKGROUND AND SUMMARY

The present invention relates to an antenna arrangement comprising a substantially planar patch conductor, and to a radio communications apparatus incorporating such an arrangement.

Wireless terminals, such as mobile phone handsets, typically incorporate either an external antenna, such as a normal mode helix or meander line antenna, or an internal antenna, such as a Planar Inverted-F Antenna (PIFA) or similar.

Such antennas are small (relative to a wavelength) and therefore, owing to the fundamental limits of small antennas, narrowband. However, cellular radio communication systems typically have a fractional bandwidth of 10% or more. To achieve such a bandwidth from a PIFA for example requires a considerable volume, there being a direct relationship between the bandwidth of a patch antenna and its volume, but such a volume is not readily available with the current trends towards small handsets. Further, PIFAs become reactive at resonance as the patch height is increased, which is necessary to improve bandwidth.

A PIFA intended for use in a dual-band application typically comprises two resonators with a common feed point. An example of such an antenna is disclosed in European patent application EP 0,997,974, in which two PIFA antennas are fed from a common point and share a common shorting pin. However, use of multiple resonators further increases the antenna volume.

An object of the present invention is to provide a planar antenna arrangement requiring a substantially smaller volume than known PIFAs while providing similar dual-band or multi-band performance.

According to a first aspect of the present invention there is provided an antenna arrangement comprising a substantially planar patch conductor supported substantially parallel to a ground plane and a feed conductor connected to the patch conductor, wherein the patch conductor is electrically insulated from the ground plane at operational frequencies of the antenna arrangement and wherein the feed conductor is coupled to a matching network arranged to provide a match to the antenna at a plurality of discrete frequencies.

Such an antenna arrangement differs from a conventional PIFA in that there is no grounding conductor connected between the patch conductor and the ground plane. By eliminating this grounding conductor and performing dual-band (or multi-band) matching with external circuitry, a better match can be achieved over a wide range of frequencies, enabling similar performance to conventional PIFA antennas to be achieved from a reduced volume and with a less complex antenna.

According to a second aspect of the present invention there is provided a radio communications apparatus including an antenna arrangement made in accordance with the present invention.

The present invention is based upon the recognition, not present in the prior art, that by eliminating the grounding pin from a PIFA and making use of a separate multi-band matching network, a significantly reduced antenna volume is possible.

BRIEF DESCRIPTION OF THE DRAWINGS

Embodiments of the present invention will now be described, by way of example, with reference to the accompanying drawings, wherein.

DETAILED DESCRIPTION

Figure 1:
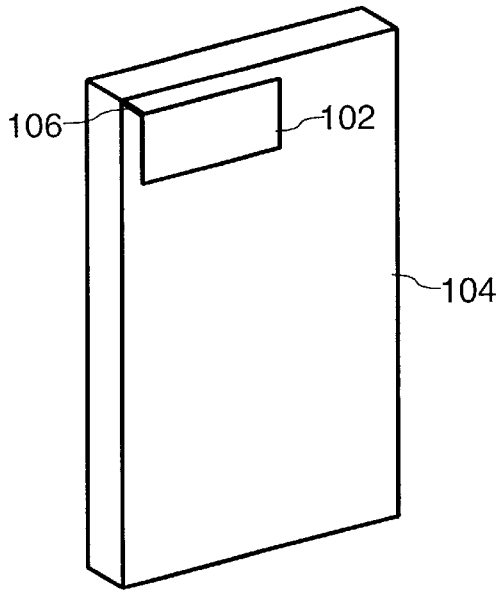
FIG. 1 is a perspective view of a Planar Inverted L Antenna (PILA) mounted on a handset.

In the drawings the same reference numerals have been used to indicate corresponding features.

A perspective view of a Planar Inverted L Antenna (PILA) mounted on a handset is shown in FIG. 1. The PILA comprises a rectangular patch conductor 102 supported parallel to a ground plane 104 forming part of the handset. The antenna is fed via a feed pin 106. Such an antenna differs from a PIFA in that there is no additional shorting pin connecting the patch conductor 102 to the ground plane 104.

In a PIFA the shorting pin performs a matching function, but this match is only effective at one frequency and is at the expense of the match at other frequencies. Our co-pending unpublished United Kingdom patent application GB0101667.4 (Applicant's reference PHGB010009) shows how the shorting and feed pins of a conventional PIFA form a short circuit transmission line in differential mode (with oppositely-directed currents on each pin). This transmission line performs a matching function (shunt reactance). An upward impedance transformation is also performed in the common mode. However, the matching produced is not optimal for dual-band (or multi-band) applications and a better match can generally be produced using discrete components.

In an example embodiment of a PILA for use in GSM and DCS frequency bands, the patch conductor 102 has dimensions 20×10 mm and is located 8 mm above the ground plane 104 which measures 40×100×1 mm. The feed pin 106 is located at a corner of both the patch conductor 102 and ground plane 104.

Figure 2:
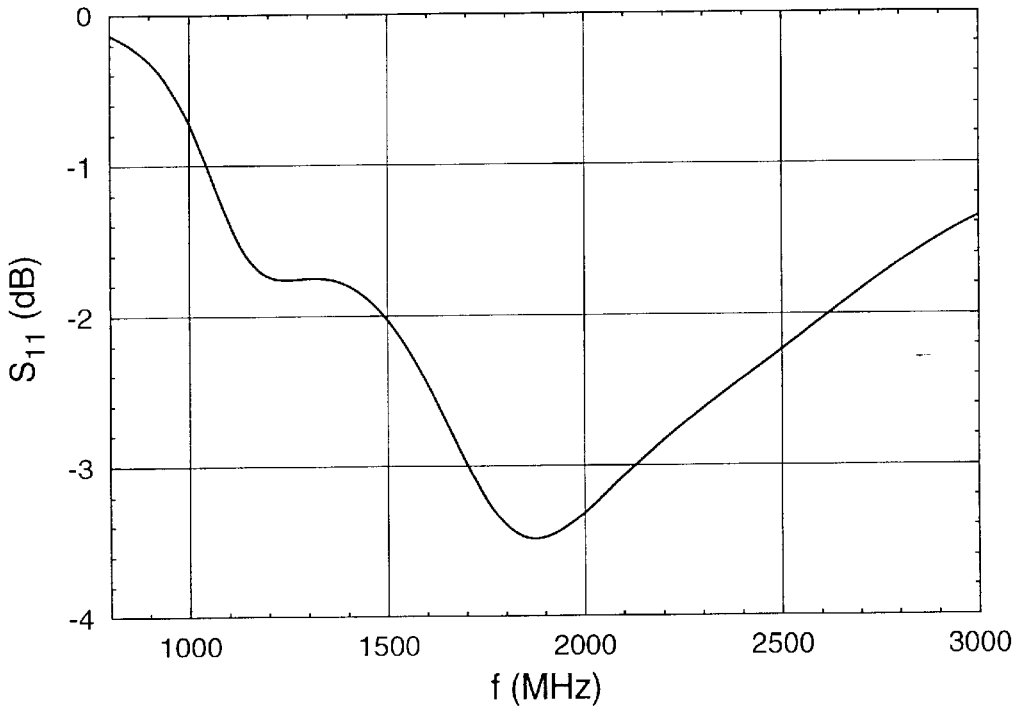
FIG. 2 is a graph of simulated return loss $S_{11}$ in dB against frequency f in MHz for the PILA of FIG. 1 without matching.
Figure 3:
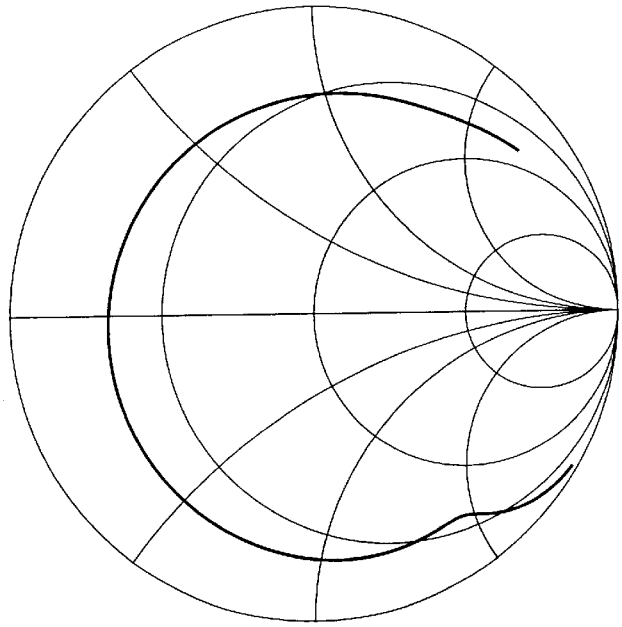
FIG. 3 is a Smith chart showing the simulated impedance of the PILA of FIG. 1 over the frequency range 800 to 3000 MHz.

The return loss $S_{11}$ of this embodiment (without matching) was simulated using the High Frequency Structure Simulator (HFSS), available from Ansoft Corporation, with the results shown in FIG. 2 for frequencies f between 800 and 3000 MHz. A Smith chart illustrating the simulated impedance of this embodiment over the same frequency range is shown in FIG. 3. The response is capacitive at low frequencies and inductive at high frequencies. The resistance only varies between 10 and 30Ω over the entire frequency range, due largely to the influence of the ground plane 104.

Figure 4:
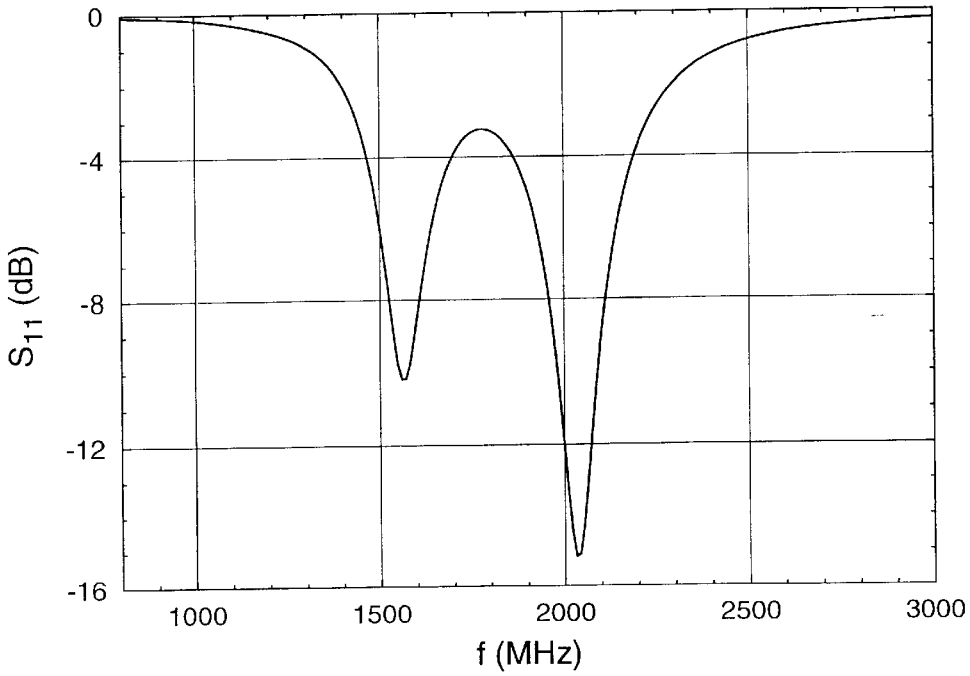
FIG. 4 is a graph of return loss $S_{11}$ in dB against frequency f in MHz for the PILA of FIG. 1 driven via a shunt LC resonant circuit.
Figure 5:
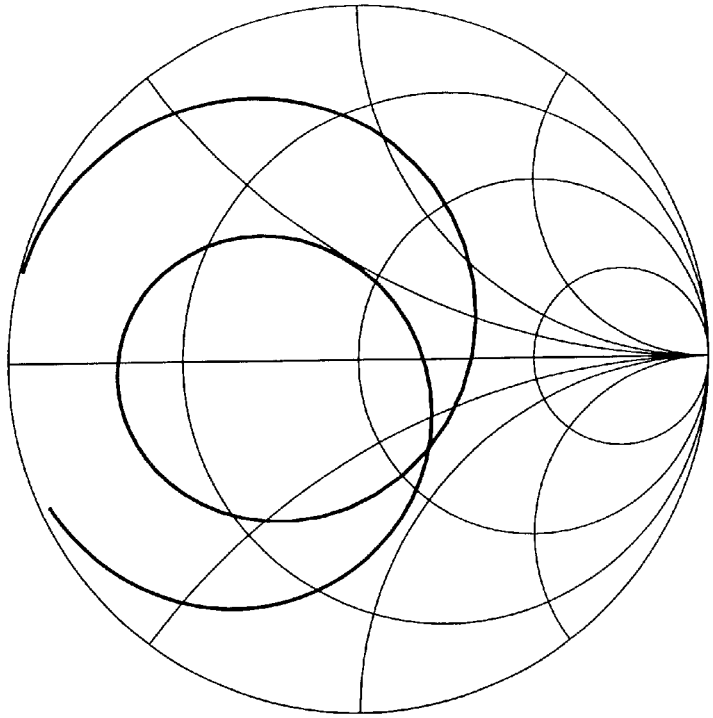
FIG. 5 is a Smith chart showing the impedance of the PILA of FIG. 1 driven via a shunt LC resonant circuit over the frequency range 800 to 3000 MHz.

This impedance characteristic makes it straightforward to apply wideband matching using a shunt LC resonant circuit connected between the feed pin 106 and ground plane 104. Simulations of the PILA shown in FIG. 1 fed via such a resonant circuit were performed, using an inductance of 1 nH and a capacitance of 8 pF, both assumed to have a constant Q of 50. Results for return loss $S_{11}$ are shown in FIG. 4 and a Smith chart is shown in FIG. 5, in both cases for frequencies f between 800 and 3000 MHz. It is clear that the LC resonant circuit provides a wideband/dual-band response with a greatly improved the antenna bandwidth.

However, the simple shunt LC matching is clearly not optimal, and could be further improved by a range of measures, including:

changing the dimensions of the patch conductor 102 or ground plane 104;

adding a series LC resonator; and adding a more conventional L, Π or T matching circuit. Use of all of these measures will be familiar to those skilled in the art.

Figure 6:
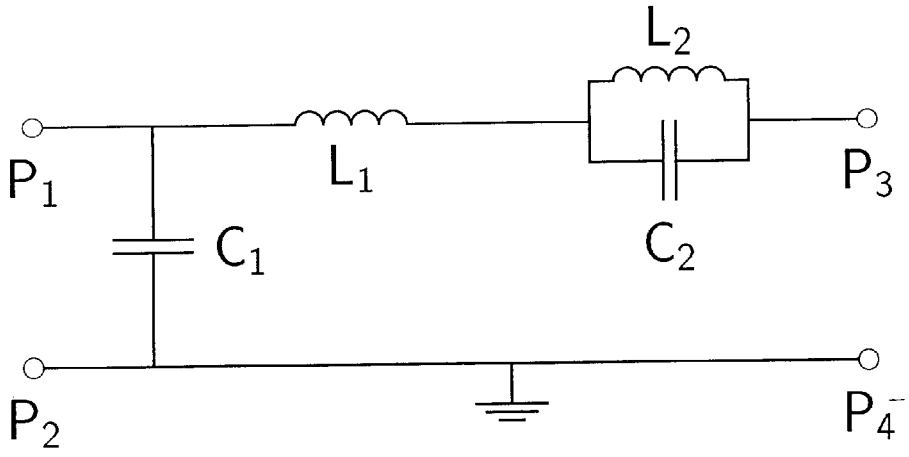
FIG. 6 is a circuit diagram of a dual-band matching circuit.

The PILA structure is also amenable to being fed via a dual-band matching circuit. An example of a suitable circuit for GSM and DCS1800 applications is shown in FIG. 6, where the components used have the following values: $C_1$ is 1.2 pF; $L_1$ is 6.5 nH; $C_2$ is 3 pF and $L_2$ is 6.9 nH. In use, the matching circuit is fed from a 50Ω source across connections $P_1$ and $P_2$, $P_3$ is connected to the feed pin 106 and $P_4$ is connected to the ground plane 104.

Figure 7:
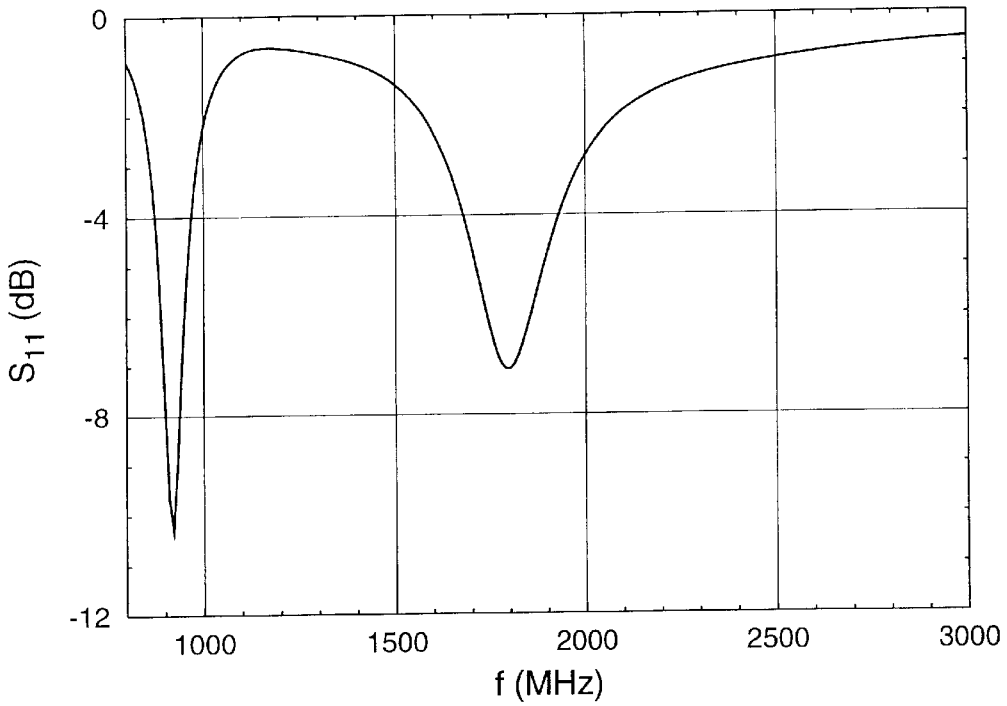
FIG. 7 is a graph of simulated return loss $S_{11}$ in dB against frequency f in MHz for the PILA of FIG. 1 driven via the matching circuit of FIG. 6.
Figure 8:
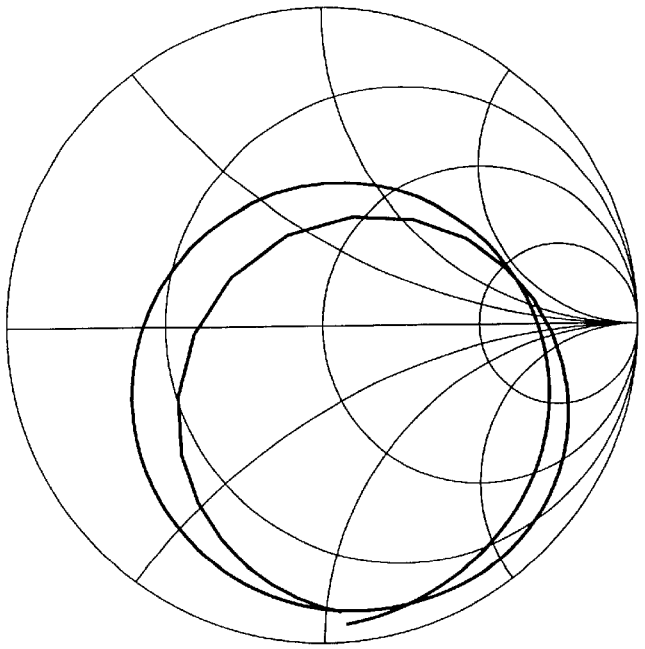
FIG. 8 is a Smith chart showing the simulated impedance of the PILA of FIG. 1 over the frequency range 800 to 3000 MHz driven via the matching circuit of FIG. 6.

Simulations of the PILA shown in FIG. 1 fed via such the dual-band matching circuit shown in FIG. 6 were performed. Results for return loss $S_{11}$ are shown in FIG. 7 and a Smith chart is shown in FIG. 8, in both cases for frequencies f between 800 and 3000 MHz. The two resonances are centred on 920 MHz, with a 3 dB bandwidth of 120 MHz, and 1810 MHz, with a 3 dB bandwidth of 350 MHZ. This performance is close to that of conventional dual-band PIFA structure. However, such a conventional dual-band PIFA would typically have dimensions of 30×30×8 mm, generating a volume of 7200 $mm^3$, which is more than four times the 1600 $mm^3$ volume of the PILA of FIG. 1.

The efficiency of the antenna, assuming each of the matching circuit components to have a Q of 50, is 40% for GSM and 70% for DCS. Again, this is close to the typical efficiency of conventional PIFA designs. It will be apparent that the return loss and efficiency could be optimised further.

A further embodiment demonstrates the wide applicability of an antenna arrangement made in accordance with the present invention. A PILA having the same dimensions as that shown in FIG. 1 is driven via a switched five-band matching circuit, shown in FIG. 9. Such a multiplexer circuit is based on one disclosed in our co-pending unpublished International patent application PCT/EP01/06760 (Applicant's reference PHGB000083). It comprises an output 902 for coupling RF signals to the feed pin 106 and a five-way switch 904 for selecting an input source. There are six inputs: UMTS receive 906 and transmit 908; DCS receive 910; DCS transmit 912; GSM receive 914; and GSM transmit 916.

UMTS signals are fed via a diplexer 918 (to permit frequency division duplex operation) and a matching network comprising a 1.5 pF capacitor $C_1$. The component values in the other arms of the matching network are: $C_2$ is 1.4 pF; $L_1$ is 0.75 nH; $L_2$ is 10 nH; $L_3$ is 14 nH; $L_4$ is 13 nH; $L_5$ is 10 nH; and $C_3$ is 0.75 pF. The matching for UMTS was designed for a 50Ω system, while that GSM and DCS transmit was designed for 10Ω and that for GSM and DCS receive for 250Ω. This demonstrates a particular advantage of such a multiplexer arrangement: individual matching of both frequency and impedance characteristics for each band is possible, enabling significantly optimised performance.

Figure 9:
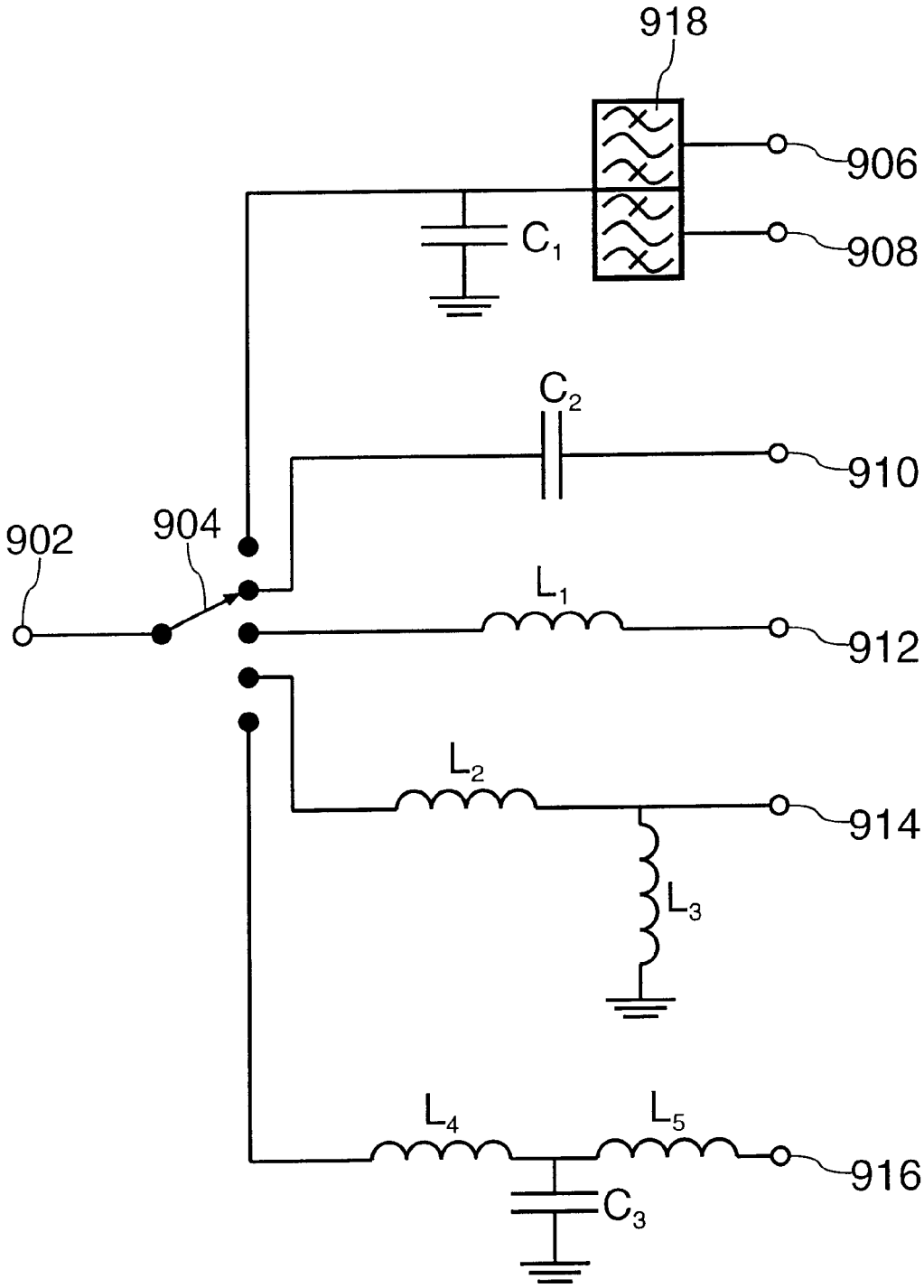
FIG. 9 is a circuit diagram of a five-band matching network for UMTS, DCS1800 and GSM.

Simulations of the PILA of FIG. 1 fed via the five-band matching circuit of FIG. 9 were performed. For these, the switch 904 was modelled as five resistors: a 2.25Ω resistor to the selected branch (equivalent to 0.2 dB in a 50Ω system) and a 50 kΩ resistor to the other branches (equivalent to 30 dB in a 50Ω system). Switches of this quality should be easily achievable with Micro ElectroMagnetic Systems (MEMS).

Figure 10:
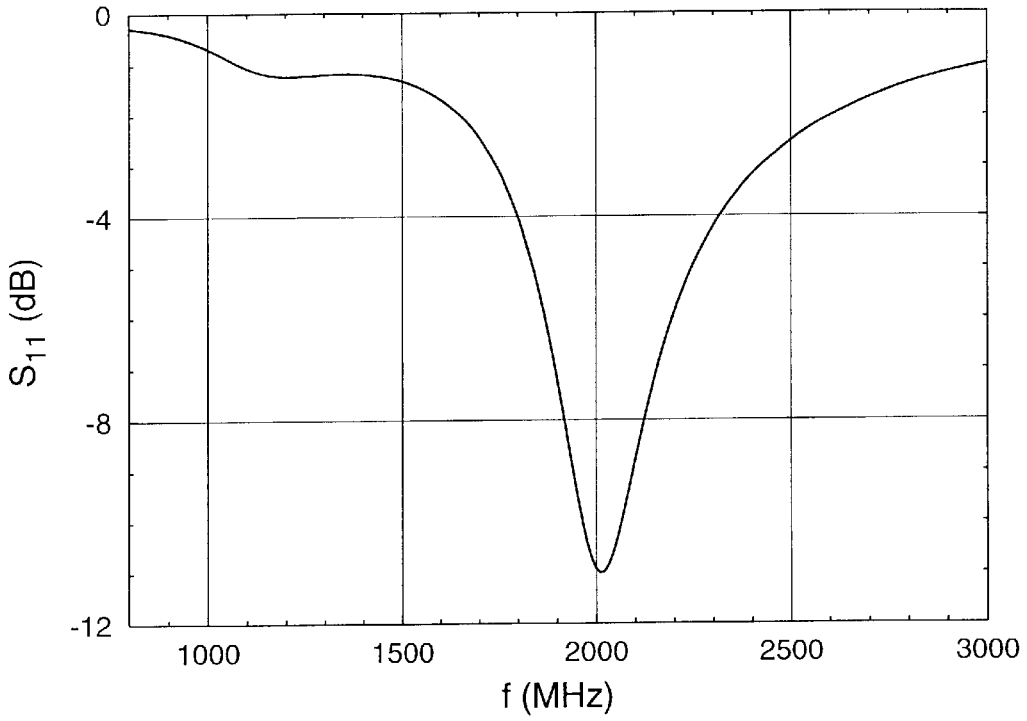
FIG. 10 is a graph of simulated return loss $S_{11}$ in dB against frequency f in MHz for the PILA of FIG. 1 driven via the UMTS matching circuit of FIG. 9.
Figure 11:
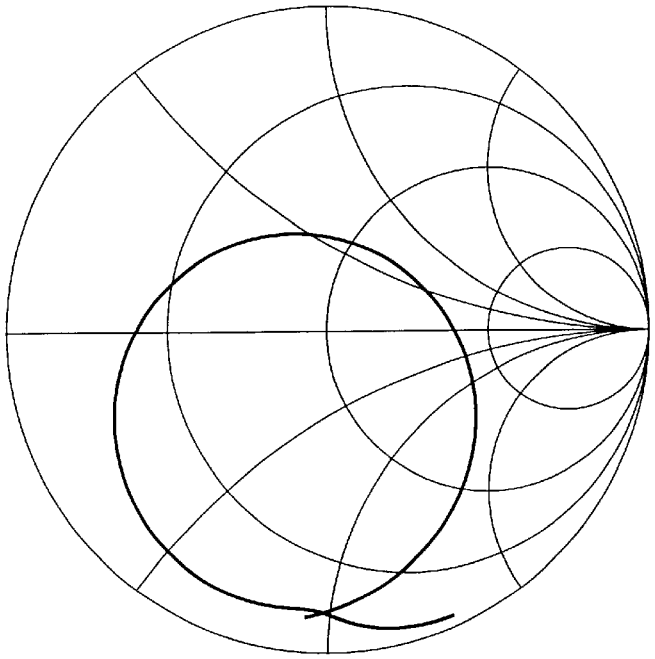
FIG. 11 is a Smith chart showing the simulated impedance of the PILA of FIG. 1 over the frequency range 800 to 3000 MHz driven via the UMTS matching circuit of FIG. 9.
Figure 12:
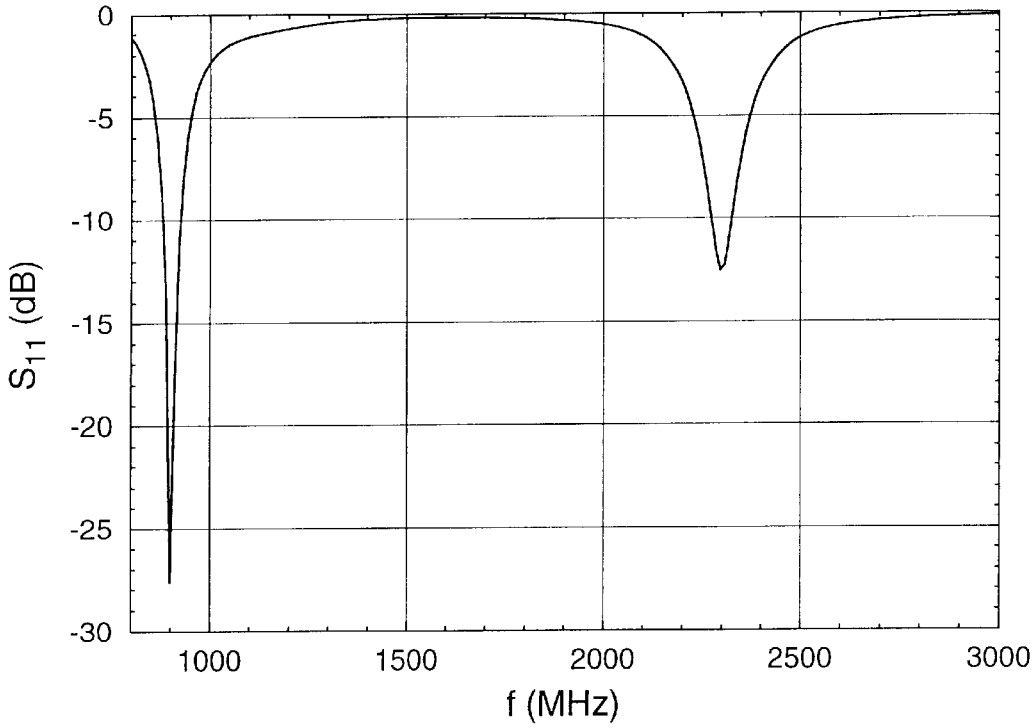
FIG. 12 is a graph of simulated return loss $S_{11}$ in dB against frequency f in MHz for the PILA of FIG. 1 driven via the GSM Tx matching circuit of FIG. 9.
Figure 13:
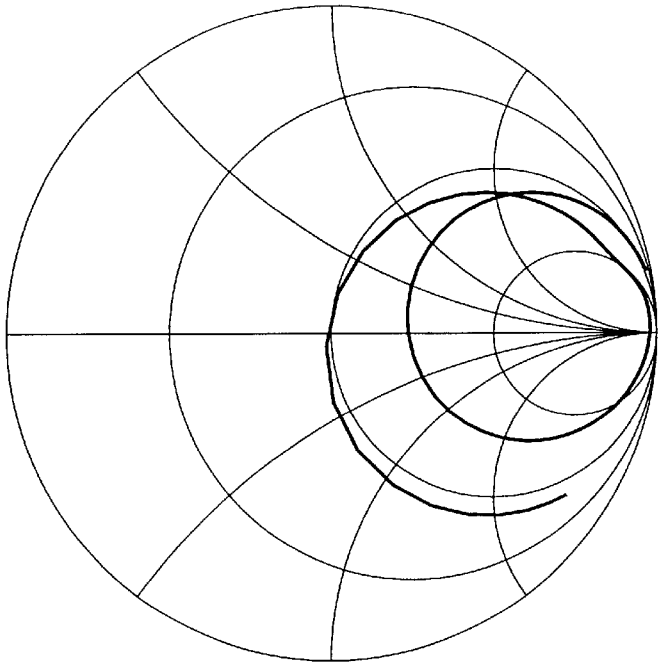
FIG. 13 is a Smith chart showing the simulated impedance of the PILA of FIG. 1 over the frequency range 800 to 3000 MHz driven via the GSM Tx matching circuit of FIG. 9.

Simulated results for return loss $S_{11}$ for frequencies f between 800 and 3000 MHz are shown in FIG. 10 for the UMTS branch, together with a Smith chart of impedance over the same frequency range in FIG. 11, and in FIG. 12 for the GSM transmit branch, together with a Smith chart in FIG. 13. Results for all the branches are summarised by the following table:

| Band | Frequency (MHz) | Bandwidth | Efficiency | Isolation |
|---|---|---|---|---|
| UMTS | 1900–2170 | 6 dB | 65% | 60 dB |
| DCS Rx | 1805–1880 | 10 dB | 60% | 50 dB |
| DCS Tx | 1710–1785 | 10 dB | 70% | 50 dB |
| GSM Rx | 935–960 | 10 dB | 60% | 40 dB |
| GSM Tx | 890–915 | 10 dB | 50% | 40 dB |

In this table, bandwidth indicates the (negative of the) maximum value of $S_{11}$ over the particular frequency band. The bandwidths are all quite acceptable, as are the efficiencies. The isolation figures indicate that the mulitplexer network provides additional isolation over that provided by the switch 904, which may be useful in many embodiments.

This embodiment demonstrates that a very compact PILA together with a multi-band matching network can provide very good performance over a range of communication bands at different frequencies.

Although in the embodiments discussed above all of the matching components were external to the antenna, some of the matching function could be performed on the antenna structure itself, for example making use of a low loss substrate supporting the antenna. This could enable inclusion of higher Q inductors, for example.

From reading the present disclosure, other modifications will be apparent to persons skilled in the art. Such modifications may involve other features which are already known in the design, manufacture and use of antenna arrangements and component parts thereof, and which may be used instead of or in addition to features already described herein.

In the present specification and claims the word "a" or "an" preceding an element does not exclude the presence of a plurality of such elements. Further, the word "comprising" does not exclude the presence of other elements or steps than those listed.

What is claimed is:

1. A planar inverted L-antenna, comprising a substantially planar patch conductor supported substantially parallel to a ground plane and a feed conductor connected to the patch conductor, wherein the patch conductor is electrically insulated from the ground plane at operational frequencies of the antenna arrangement and wherein a matching network is connected between the feed pin and the ground plane to provide a match to the planar inverted L-antenna at a plurality of discrete frequencies.

2. The planar inverted L-antenna as claimed in claim 1, characterised in that the ground plane is spaced from, and co-extensive with, the patch conductor.

3. The planar inverted L-antenna as claimed in claim 1, characterised in that the matching network comprises a plurality of inputs coupled to a plurality of matching circuits and switching means to select one of the plurality of matching circuits, and in that the output of the switching means is coupled to the feed conductor.

4. The planar inverted L-antenna as claimed in claim 3, characterised in that the switching means comprises MEMS switches.

5. A radio communications apparatus including a planar inverted L-antenna as claimed in claim 1.

6. A planar inverted L-antenna as recited in claim 1, wherein the matching network is a shunt LC resonant circuit.

7. A planar inverted L-antenna as recited in claim 1, wherein the matching network is a series LC resonant circuit.

8. A planar inverted L-antenna as recited in claim 1, wherein the matching network is a multi-band matching network.

* * * * *